United States Patent [19]

Dunker

[11] Patent Number: 4,624,089

[45] Date of Patent: Nov. 25, 1986

[54] TIE ANCHOR FOR REINFORCED SANDWICH PANELS

[75] Inventor: Friedrich W. Dunker, Altena, Fed. Rep. of Germany

[73] Assignee: Siegfried Fricker, Wiernsheim, Fed. Rep. of Germany

[21] Appl. No.: 631,087

[22] Filed: Jul. 16, 1984

[30] Foreign Application Priority Data

Jul. 14, 1983 [DE] Fed. Rep. of Germany ..... 3325352

[51] Int. Cl.[4] ..... E04C 5/18

[52] U.S. Cl. ..... 52/410; 52/309.11; 52/307.12; 52/712; 52/714

[58] Field of Search ..... 52/410, 712, 713, 714, 52/715, 393, 309.11, 309.12, 370, 378, 650

[56] References Cited

U.S. PATENT DOCUMENTS

| | | | |
|---|---|---|---|
| 861,215 | 7/1907 | Kahn | 52/650 |
| 908,310 | 12/1908 | McDonald | 52/714 |
| 1,622,697 | 3/1927 | Baily | 52/370 |
| 1,649,407 | 11/1927 | Isaacson | 52/714 X |
| 1,832,231 | 11/1931 | Menninger | 52/378 |
| 2,653,469 | 9/1953 | Callan | 52/712 X |
| 3,349,536 | 10/1967 | Halko, Jr. et al. | 52/712 X |
| 3,383,817 | 5/1968 | Gregori | 52/309.11 |
| 3,757,482 | 9/1973 | Haeussler | 52/378 X |
| 4,283,896 | 8/1981 | Fricker et al. | 52/712 X |

FOREIGN PATENT DOCUMENTS

| | | | |
|---|---|---|---|
| 2021192 | 4/1972 | Fed. Rep. of Germany | 52/410 |
| 2403717 | 7/1975 | Fed. Rep. of Germany | 52/410 |
| 7903465 | 10/1979 | Netherlands | 52/714 |
| 279209 | 3/1952 | Switzerland | 52/714 |
| 649622 | 1/1951 | United Kingdom | 52/712 |

*Primary Examiner*—William F. Pate, III
*Assistant Examiner*—Jean M. Lakemper
*Attorney, Agent, or Firm*—Joseph A. Geiger

[57] ABSTRACT

A tie anchor for use in reinforced sandwich panels of cast concrete, to support a face panel on a carrier panel by reaching through an intermediate insulating panel, the tie anchor being a sheet metal stamping with a central A-shaped end portion on one axial end and a V-shaped recess flanked by two tapered end portions on the other axial end. Hook portions formed of the tapered end portions are engageable over a rod of a reinforcing steel rod mesh and attachable thereto by means of positioning rods which are inserted through transverse positioning bores in the hook portions.

10 Claims, 7 Drawing Figures

TIE ANCHOR FOR REINFORCED SANDWICH PANELS

BACKGROUND OF THE INVENTION

1. Field of the Invention

The present invention relates to metallic anchoring elements for structural building components and, more particularly to a tie anchor for reinforced sandwich panels of cast concrete in which a number of tie anchors support a face panel on a carrier panel by reaching through an intermediate insulating panel.

2. Description of the Prior Art

From the prior art in this field is known a tie anchor of stainless steel sheet in the form of a rectangular flat plate with positioning bores near its small sides at the axial ends of the tie anchor body, each axial end portion of the tie anchor reaching through an interstice in a reinforcing steel rod mesh of one of the two concrete panels, where the tie anchor is secured by means of positioning rods which engage the positioning bores of the end portions behind the associated steel rod mesh.

This known tie anchor, while being of simple shape and very easy to insert through an intermediate insulating panel of foamed plastic, has the shortcoming that it does not offer the possibility of securing the tie anchor in the casting form in a predetermined orientation in relation to the reinforcing steel rod mesh, prior to and during the casting of the first panel.

Accordingly, it is possible for these prior art tie anchors to be pivoted out of position by the flowing concrete, as the first panel of the assembly is cast around its reinforcing steel rod mesh. Only the concrete of a cured first panel stabilizes the orientation of the tie anchors during the subsequent assembly steps.

A further shortcoming of this prior art tie anchor relates to the fact that it may create problems in connection with the insertion of its end portions through the interstices of the two steel rod meshes. On the one hand, the interstices of one mesh may not be transversely aligned with those of the other mesh. On the other hand, the structural requirements may demand a tie anchor of a width which is larger than the mesh openings.

Attempts to realign the second steel rod mesh in the casting form in response to misaligned interstices are subject to the risk of creating distortions and/or a permanent misalignment between the two steel rod meshes. In the past, therefore, the solution to both problem situations has been to cut away parts of the steel rod mesh, in order to create the necessary openings for the insertion of the tie anchors. Obviously, the result of this kind of remedial action is a weakening of the reinforcing steel rod mesh, the weakened area being the area in which the tie anchor is attached to the mesh.

SUMMARY OF THE INVENTION

Underlying the present invention is the primary objective of suggesting an improved tie anchor for reinforced sandwich panels of cast concrete which, while preserving the advantages of the prior art anchor of simplicity, low production cost and ease of installation in terms of its attachability to the steel rod mesh and effortless insertion through the insulating panel, does not have the stated shortcomings of the known prior art tie anchor, inasmuch as the improved tie anchor permits the establishment and maintenance of a predetermined selectively perpendicular or inclined orientation of the tie anchor in its attachment to the steel rod mesh, prior and during the concrete casting operation, and inasmuch as it does not require the transverse alignment of the interstices of the two steel rod meshes.

The present invention proposes to attain this objective by suggesting a tie anchor with the following features:

(a) The tie anchor has a substantially flat body with a longitudinal axis, with each axial end of the tie anchor forming at least one convergingly tapered end portion;

(b) Each of said end portions has at least one positioning bore for the insertion of a tie anchor positioning rod;

(c) At least one axial end of the tie anchor has two transversely spaced convergingly tapered end portions;

(d) The tapered end portion, or end portions, on one of the two axial ends of the anchor body form a hook portion around a half-loop, each hook portion including a bent hook portion extending at a distance from an unbent hook portion which is aligned with the tie anchor body, so that the hook portion, or portions, are engageable over a reinforcing rod in one of the two panels; and (e) Each hook-portion-forming tapered end portion has aligned positioning bores in its bent and unbent hook portions, for the insertion therethrough of a positioning rod which, when the hook portion, or hook portions, are engaged over the reinforcing rod, reaches behind the latter in an orientation which is transverse thereto, thereby positioning and orienting the tie anchor during the casting of the first panel.

The convergingly tapered end portions of the novel tie anchor make it possible to attach the end portions to steel rod meshes which are positioning out of alignment and/or have interstices which are smaller than the width of the tie anchor.

By arranging two tapered end portions on one axial end of the tie anchor, the latter is connectable to the steel rod mesh at two spaced attachment points, thereby giving the tie anchor excellent stability and high shear resistance. The initially unattached end portion on the other axial end of the tie anchor is flat, so that it can be inserted through the intermediate insulating panel without difficulty and without risk of shifting the insulating panel out of position.

In a preferred embodiment of the invention, the tie anchor body is a stamping which is symmetrical with respect to a longitudinal axis, having parallel longitudinal edges, a central A-shaped end portion on one axial end, and two laterally spaced tapered end portions flanking a central V-shaped recess on the other axial end. By making the outline of the V-shaped recess complimentary to the A-shaped end portion, it is possible to create with a single cut the recess on one tie anchor body and the end portion on another tie anchor body. This makes it possible to stamp the tie anchor bodies from a continuous strip of stainless steel sheet, virtually without waste of metal.

By choosing for the A-shaped extension a base which is narrower than the tie anchor body itself, it is possible to truncate the tapered end portions on on the other axial end along a corresponding complementary outline.

With two hook portions at the two laterally spaced end portions, the tie anchor is suited for use in sandwich panels which are produced by the so-called positive casting method. With a single hook portion at the A-shaped portion, the tie anchor is suited for use in sandwich panels which are produced by the so-called negative casting method. Both versions of the tie anchor are conveniently obtained from the same sheet metal stamping.

A modified shape of the tie anchor body featuring two laterally spaced tapered end portions and central V-shaped recesses on both axial ends is suitable for use in conjunction with sandwich panels which are produces by either of the two casting methods.

By way of a further improvement, the present invention also suggests that the hook portion, or hook portions, have a straight end at the bent hook portion which defines a small acute angle with the unbent portion to form a divergingly tapered pocket which gives the tie anchors convenient stackability.

BRIEF DESCRIPTION OF THE DRAWINGS

Further special features and advantages of the invention will become apparent from the description following below, when taken together with the accompanying drawings which illustrate, by way of example, preferred embodiments of the invention which are represented in the various figures as follows.

DESCRIPTION OF THE PREFERRED EMBODIMENTS

Figure 1:
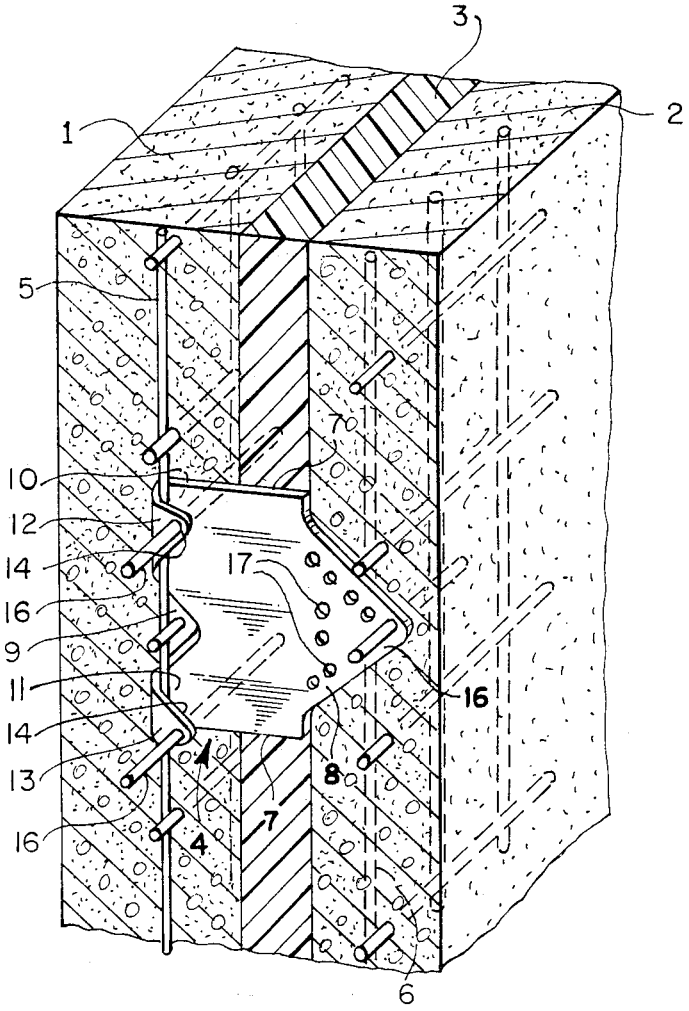
FIG. 1 shows, in a perspective representation, a portion of a reinforced sandwich panel with a tie anchor embodying the present invention.

FIG. 1 shows a portion of a reinforced sandwich panel assembly consisting essentially of a heavy carrier panel 1 on the back side of the assembly, a lighter face panel 2 on the front side, and an insulating panel 3 sandwiched between the panels 1 and 2. A tie anchor 4 reaches from the carrier panel 1 transversely through the insulating panel 3 and into the face panel 2.

The carrier panel 1 and the face panel 2 are cast of concrete and reinforced by means of steel rod meshes 5 and 6, respectively. The insulating panel 3 is preferably a panel of foamed plastic. The tie anchor 4 is a generally flat part which is stamped from a strip of stainless steel sheet. The latter may be stainless steel stock of 1.5 mm gauge, for example.

Figure 3:
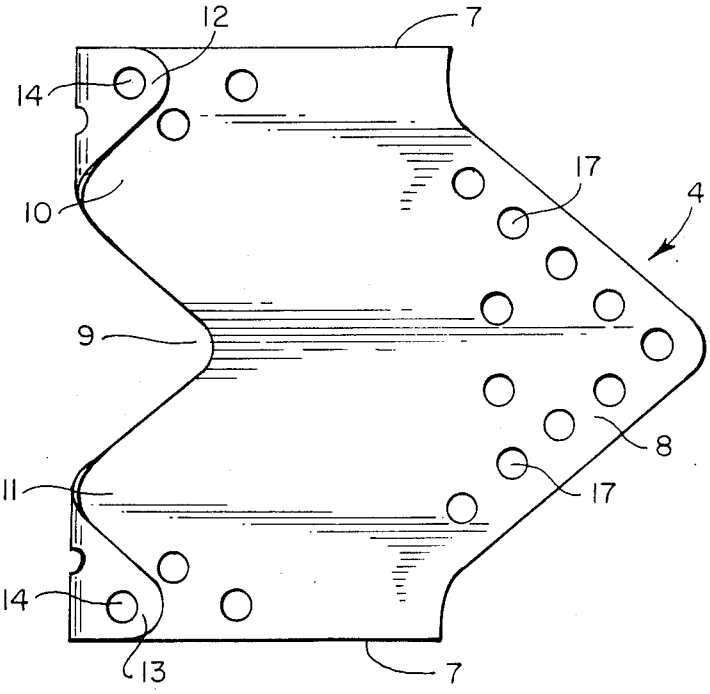
FIG. 3 shows the tie anchor of FIG. 1 in a plan view, as formed from the tie anchor blank of FIG. 2.
Figure 4:
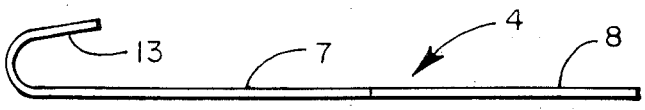
FIG. 4 shows the tie anchor of FIG. 3 in a side view.

The tie anchor 4, which is shown in more detail in FIGS. 3 and 4, has a contour which is symmetrical with respect to a longitudinal center axis, the contour being formed by two parallel longitudinal edges 7, an A-shaped end portion 8 on one axial extremity and a V-shaped central recess 9 on the other axial extremity. The width at the base of the A-shaped end portion is somewhat smaller than the overall width defined between the longitudinal edges 7, leaving shoulder portions as a transition.

The V-shaped recess 9 and the longitudinal edges 7 form two transversely spaced lateral end portions 10 and 11 of tapered outline. The shapes of the A-shaped end portion 8 and of the V-shaped central recess 9 are preferably complimentary, so that, in a stamping operation, a single cut produces an end portion 8 on one part and a central recess 9 an the next part. This makes it possible to stamp a succession of tie anchors from a sheet metal strip with virtually no waste of stock.

Figure 2:
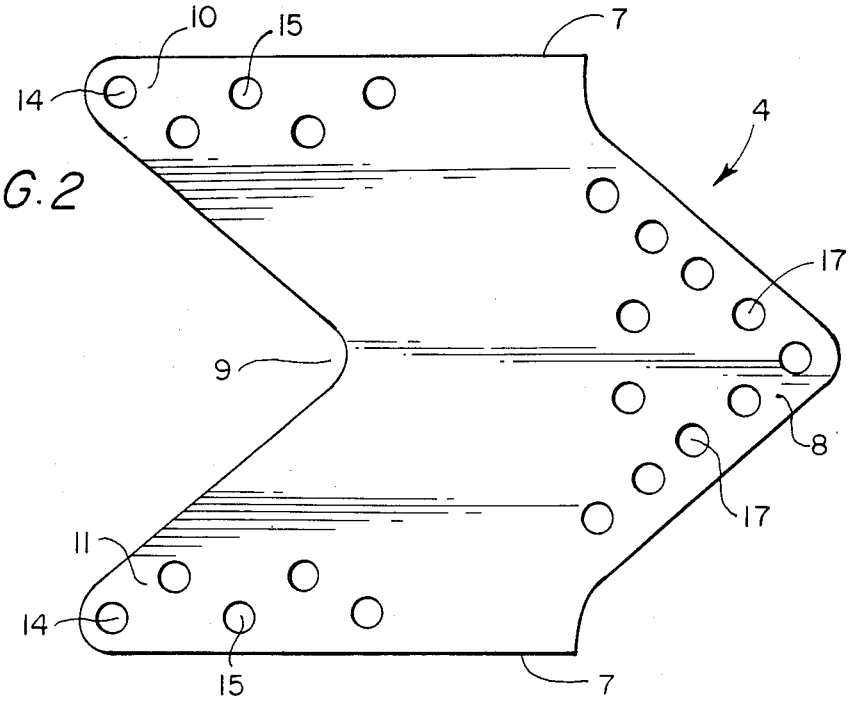
FIG. 2 shows, at an enlarged scale, a stamped blank of the tie anchor of FIG. 1.

The corners of the lateral end portions 10 and 11 may be truncated or rounded off, as shown in FIGS. 2 and 3, in order to minimize the risk of injury to a worker's hand during the assembly operation. This truncation is complimentary to the shoulder portions at the base of the A-shaped end portion.

As can be seen in FIGS. 1, 3 and 4, the two lateral end portions 10 and 11 are bent back to form two hook portions 12 and 13, respectively, with the hook extremities pointing in the general direction of the A-shaped end portions 8. FIG. 4 further shows that the hook portions 12 and 13 have bent hook portions with a short, straight extremity and unbent hook portions which remain in alignment with the tie anchor 4. The bent and unbent hook portions define a bending angle which is less than 180°, preferably about 170°, in order to form outwardly tapered pockets which make it possible for a number of tie anchors to be assembled in a stack, thereby reducing the space requirements in storage and during shipping.

In each of the two hook portions 12 and 13 are arranged at least two spaced positioning bores 14 and 15 in such a way that a bore 14 in the bent part of the hook portions 12 and 13 is aligned with a bore 15 in the unbent part in the plane of the tie anchor 4, so that a positioning rod 16 can be inserted through the bores 14 and 15 at right angles to the plane of the tie anchor 4. The space between the fillet of the hook portions 12 and 13 and the engaged positioning rods 16 is such that, when the hook portions 12 and 13 are engaged over a rod of the steel rod mesh 5, as shown in FIG. 1, the two positioning rods 16 lock the tie anchor 4 against the steel rod with minimal clearance, in a substantially perpendicular orientation to the steel rod mesh 5.

It should be understood, however, that, by modifying the alignment of the positioning bores 14 and 15 in relation to the plane of the tie anchor 4, it is also possible to achieve a predetermined inclination of the tie anchor 4, when the latter is mounted on the steel rod mesh 5. Such an inclination may, in fact, be advantageous, if it is applied in such a way that at least two tie anchors are oriented at unequal angles from the steel rod mesh 5.

Figure 7:
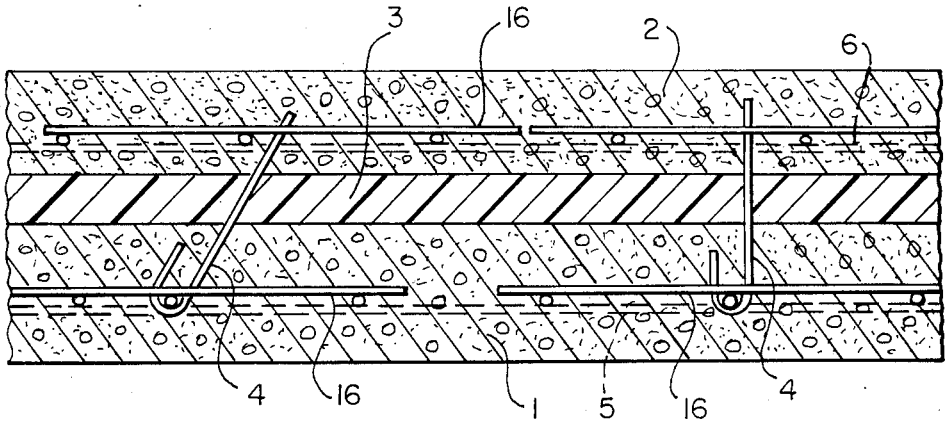
FIG. 7 shows a reinforced sandwich panel in longitudinal cross section with two tie anchors embedded therein.

Unequal angles of orientation of two or more tie anchors tend to enhance the stiffness of the sandwich panel, inasmuch as parallel tie anchors can permit limited relative displacements between the carrier panel 1 and the face panel 2 by responding in the manner of parallel linkages, whereas differently inclined tie anchors will block such displacements. An arrangement of two differently oriented tie anchors is shown in FIG. 7.

The desired orientation of the positioning bores 14 and 15 in the hook portions 12 and 13 may be achieved by piercing the bores in conjunction with the blanking operation on the sheet metal stamping, i.e., prior to bending of the lateral end portions 10 and 11 into the hook portions 12 and 13, respectively. Alternatively, the tie anchor inclination may be selected at the time of assembly, by drilling the positioning bores, or additional bores, for example. The latter approach offers the advantage that the choice of orientation of the tie anchor 4 in the sandwich panel assembly can be made on the spot, in response to the particular situation at hand.

FIGS. 2 and 3 show that the A-shaped end portion 8 has several rows of positioning bores 17 through one or more of which a positioning rod 16 is insertable. The various positioning rods 16 engaging the hook portions 12 and 13 and the flat end portion 8 of the tie anchor 4 are attached to and supported by the reinforcing steel rod mesh 5 and 6, respectively.

In the following will be described how a typical reinforced sandwich panel with tie anchors in accordance with the present invention is produced by the so-called positive casting method, using a casting form which is not shown in the drawing:

At the outset, the reinforcing steel rod mesh 5 is positioned in the casting form, at a distance from the bottom of the form, using suitable known spacer elements. To the steel rod mesh 5 are attached a number of tie anchors 4 (compare FIG. 7), by engaging their hook portions 12 and 13 over a rod of the mesh 5 and securing each tie anchor 4 by inserting two positioning rods 16 through the positioning bores 14 and 15 of their hook portions. As the carrier panel 1 is cast, the steel rod mesh 5 and a portion of each tie anchor 4 become embedded in concrete.

Onto the carrier panel 1 is then placed an insulating panel 3, whereby the protruding flat portions of the tie anchors 4 penetrate through the panel 3. Since this insulating panel is normally fairly slim and of relatively soft material, there is in most cases no need to prepare openings for the penetration of the tie anchors.

In the next operation, the reinforcing steel rod mesh 6 is positioned in the casting form at a vertical distance from the insulating panel 3, using again known spacer elements. The level of the steel rod mesh 6 is such that part of the A-shaped end portion 8 of each tie anchor 4 reaches into and through the mesh 6, so that a positioning rod 16 can be inserted through at least one of its positioning bores 17 in such a way that the positioning rod 16 is supported by the steel rod mesh 6. In a final operation, the face panel 2 is cast in the casting form.

The A-shaped end portion 8 of the tie anchor 4 has a number of positioning bores 17, in order to make it possible to use a given size of tie anchor for sandwich panels of varying thickness. In situations in which the tips of the end portions 8 are so positioned that they would protrude over the outer side of the face panel 2, that part of the end portion which extends beyond the engaged positioning rod 16 is simply bent sideways towards the positioning rod to submerge it in the concrete of the face panel 2.

Each sandwich panel requires a number of tie anchors in appropriate distribution over its area. The tie anchor of the invention has the advantage of being able to withstand elevated shear forces between the carrier plate 1 and the face plate 2, because it is attached to the reinforcing steel rod mesh 5 of the carrier panel 1 at two widely spaced attachment points, as can be seen in FIG. 1.

Figure 5:
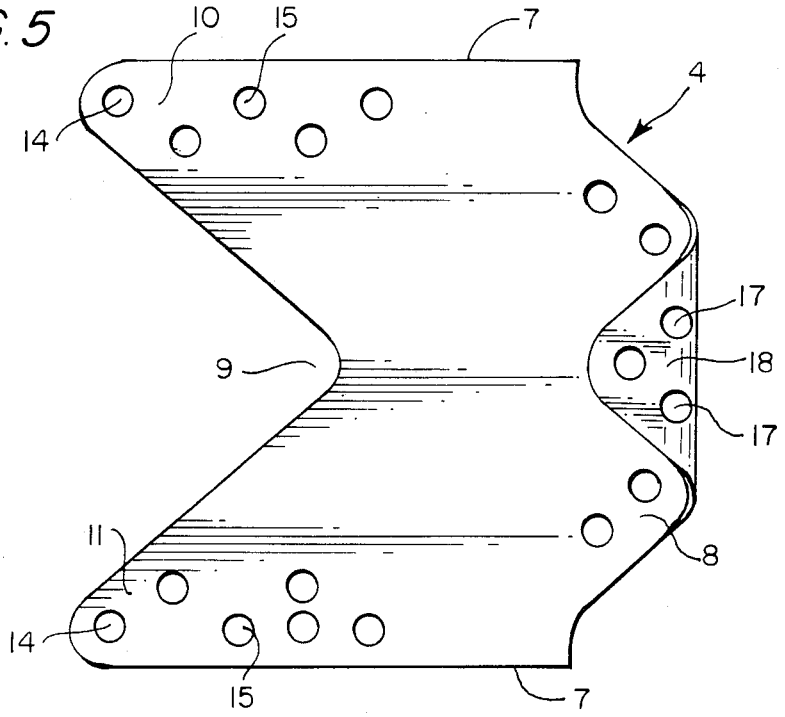
FIG. 5 is a plan view of a modified tie anchor representing a second embodiment of the invention.

In conjunction with reinforced sandwich panels which are produced by the so-called negative casting method, in which the face panel 2 is the first panel to be cast in the casting form, it may be advantageous to use a modified tie anchor, like the one which is shown in FIG. 5. In this embodiment, the A-shaped end portion 8 has been bent to form a hook portion 18, while the two laterally spaced tapered end portions 10 and 11 are left flat.

Like the hook portions 12 and 13 of the previously described embodiment (FIG. 3), the hook portion 18 is engaged over a rod of the steel rod mesh 6 and secured by means of a positioning rod 16 which is inserted through two aligned positioning bores 17 of the hook portion 18. In this case, it is the flat lateral end portions 10 and 11 which penetrate through the insulating panel 3 to reach into the steel rod mesh 5 of the carrier panel 1, where they are secured by means of two positioning rods 16.

Comparing FIG. 5 with FIGS. 2 and 3, it can be seen that both the tie anchor of FIG. 3 and the tie anchor of FIG. 5 are obtained from the same sheet metal stamping of FIG. 2. This advantageous feature reflects itself in a reduction in tooling costs and in savings in terms of inventory costs.

Figure 6:
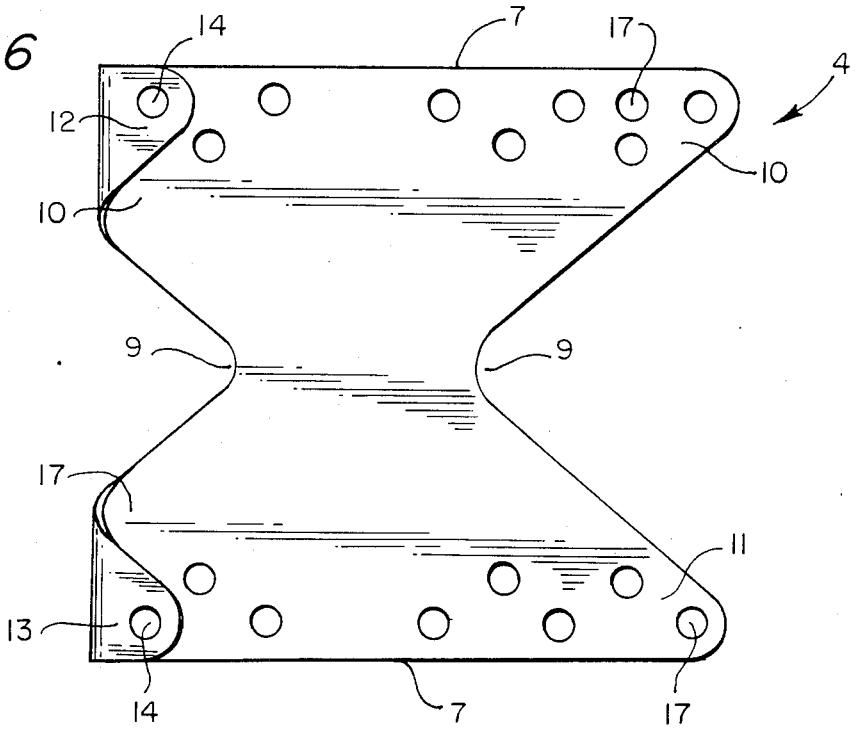
FIG. 6 is a plan view of a further modified tie anchor representing a third embodiment of the invention.

A third version of a tie anchor of the type suggested by the present invention is shown in FIG. 6. This tie anchor has a developed contour which is symmetrical with respect to a longitudinal as well as a transverse axis by having V-shaped recesses 9 on both axial ends.

The tie anchor of FIG. 6 is suitable for use in sandwich panels which are produced by the positive casting method and in panels which are produced by the negative casting method. Its disadvantage in comparison to the two earlier-described tie anchors is that it requires more raw material, inasmuch as strip stock equivalent to twice the area of the V-shaped recess 9 is lost in the stamping process.

Any one of the three versions of the tie anchor of the invention may have one or more longitudinal stiffening beads in the anchor body.

The use of a reinforcing steel rod mesh is not a prerequisite to the implementation of the present invention. On the other hand, the tie anchors of the present invention may also be used in sandwich panels which do not have an intermediate insulating panel, featuring in its place an insulating air space between the carrier panel and the face panel.

It should be understood, of course, that the foregoing disclosure describes only a preferred embodiment of the invention and that it is intended to cover all changes and modifications of this example of the invention which fall within the scope of the appended claims.

I claim the following:

1. A tie anchor for cast sandwich panels and the like, particularly sandwich panels of the type which comprise two spaced panels of steel-rod-reinforced cast concrete or comparable reinforced building wall material and an intermediate insulating layer or insulating air space, wherein one of the two panels is a carrier panel and the other one is a face panel and the tie anchor is designed to support the face panel on the carrier panel by having at least one end portion embedded in each panel, as the latter are cast in succession, the tie anchor comprising:

a substantially flat tie anchor body having a longitudinal axis;

at least one convergingly tapered end portion defined by each axial end of the tie anchor body, at least one of said axial ends defining two transversely spaced, convergingly tapered end portions; and at least one positioning bore in each of said tapered end portions, for the insertion therethrough of a tie anchor positioning rod; and wherein the tapered end portion, or end portions, respectively, on one of the two axial ends of the tie anchor body form a hook portion around a half-loop bend, at a bending line which extends transversely to the longitudinal axis of the tie anchor body;

each hook portion includes a bent hook portion extending at a distance from an unbent hook portion which is aligned with the tie anchor body, so that the hook portion, or portions, respectively, are engageable over a reinforcing rod in one of said two panels; and each hook-portion-forming tapered end portion has at least one pair of aligned positioning bores in its bend and unbent hook portions, for the insertion of a positioning rod through said pair of aligned bores, which positioning rod locks the tie anchor to the reinforcing rod by engaging the side of the reinforcing rod opposite the side engaged by the hook portion, or hook portions, respectively, thereby positioning and orienting the tie anchor in relation to the reinforcing rod during casting of the first panel.

2. A tie anchor as defined in claim 1, wherein the developed outline of the tie anchor body is in part defined by two longitudinal edges and a central convergingly tapered end portion on one of its axial ends; and the developed outline of the tie anchor body is further defined by two laterally spaced convergingly tapered end portions on the other one of its axial ends, the extremities of said laterally spaced tapered end portions being located near the longitudinal edges of the tie anchor body.

3. A tie anchor as defined in claim 2, wherein the longitudinal edges of the developed tie anchor body are parallel edges;

said central convergingly tapered end portion is an A-shaped end portion, and said laterally spaced tapered end portions define between them a V-shaped central recess;

the A-shaped end portion forms a complimentary match with the V-shaped recess, so that the end portion of a first one of two identical developed tie anchors fits into the recess of the second developed tie anchor substantially without a gap; and the developed outline of the tie anchor body is symmetrical with respect to its longitudinal axis.

4. A tie anchor as defined in claim 3, wherein the width at the base of said A-shaped end portion of the developed tie anchor body is narrower than the width defined by its two longitudinal edges, the outline of the developed tie anchor body further including corresponding lateral shoulders between the base of the A-shaped end portion and said longitudinal edges; and the laterally spaced tapered end portions on the opposite axial end of the developed tie anchor body have truncated extremities forming a complimentary match with said shoulders.

5. A tie anchor as defined in any one of claims 2 through 4, wherein two hook portions are formed from said two laterally spaced tapered end portions and transversely aligned with each other, so as to be engageable over a single straight reinforcing rod.

6. A tie anchor as defined in any one of claims 2 through 4, wherein a single hook portion is formed from said central convergingly tapered end portion.

7. A tie anchor as defined in claim 1, wherein the outline of the developed tie anchor body is defined by two longitudinal edges and by two laterally spaced convergingly tapered end portions on both axial ends of the developed tie anchor body;

the extremities of said laterally spaced tapered end portions are located near said longitudinal edges, forming between them a V-shaped central recess on both axial ends of the developed tie anchor body; and two hook portions are formed from two laterally spaced tapered end portions on one axial end of the tie anchor body, said hook portions being transversely aligned with each other, so as to be engageable over a single straight reinforcing rod.

8. A tie anchor as defined in claim 7, wherein the developed outline of the tie anchor body is symmetrical with respect to both its longitudinal axis and an axis which is perpendicular to its longitudinal axis.

9. A tie anchor as defined in claim 1, wherein the hook portion, or hook portions, respectively, include a substantially straight end at the bent hook portion defining a small acute angle with the unbent hook portion and the aligned tie anchor body, so as to form an divergingly tapered pocket; and a plurality of identical tie anchors are stackable by engaging the hook portion, or portions, of one tie anchor into the tapered pocket, or pockets, respectively, formed by the hook portion, or portions, of another tie anchor.

10. A tie anchor as defined in claim 1, wherein the tie anchor body includes at least one longitudinal stiffening bead.

* * * * *